US006309442B1

(12) United States Patent
Usher

(10) Patent No.: US 6,309,442 B1
(45) Date of Patent: Oct. 30, 2001

(54) REFRACTORY MATERIAL SENSOR FOR DETERMINING LEVEL OF MOLTEN METAL AND SLAG AND METHOD OF USING

(76) Inventor: John D. Usher, 601 4$^{th}$ Ave., Beaver Falls, PA (US) 15010-3213

( * ) Notice: Subject to any disclaimer, the term of this patent is extended or adjusted under 35 U.S.C. 154(b) by 0 days.

(21) Appl. No.: 09/512,807

(22) Filed: Feb. 25, 2000

(51) Int. Cl.$^{7}$ ..... C21C 7/00

(52) U.S. Cl. ..... 75/386; 73/304 R; 266/44; 266/94; 266/99

(58) Field of Search ..... 266/80, 94, 99; 75/375, 386, 584; 164/4.1, 151.3; 73/304 R

(56) References Cited

U.S. PATENT DOCUMENTS

| | | | |
|---|---|---|---|
| 3,395,908 | 8/1968 | Woodcock | 266/34 |
| 3,461,722 | 8/1969 | Martens | 73/304 |
| 3,505,062 | 4/1970 | Woodcock | 75/60 |
| 3,663,204 | 5/1972 | Jungwirth | 75/49 |
| 4,037,761 | 7/1977 | Kemlo et al. | 222/590 |
| 4,150,974 | 4/1979 | Kemlo | 75/60 |
| 4,235,423 | 11/1980 | Kemlo | 266/99 |
| 4,345,746 | 8/1982 | Schleimer et al. | 266/90 |
| 4,365,788 | 12/1982 | Block | 266/44 |
| 4,413,810 | 11/1983 | Tenberg et al. | 266/94 |
| 4,544,140 | 10/1985 | Tenberg et al. | 266/99 |
| 4,903,530 | 2/1990 | Hull | 73/304 |
| 5,375,816 | 12/1994 | Ryan et al. | 266/44 |
| 5,549,280 | 8/1996 | Kings et al. | 266/78 |
| 5,650,117 | 7/1997 | Kings et al. | 266/44 |
| 5,827,474 | 10/1998 | Usher et al. | 266/44 |

FOREIGN PATENT DOCUMENTS

| | | | |
|---|---|---|---|
| 61-15078 * | 1/1986 | (JP) | 266/94 |
| 63-37217 * | 2/1988 | (JP) | 266/94 |

* cited by examiner

*Primary Examiner*—Melvyn Andrews
(74) *Attorney, Agent, or Firm*—Roylance, Abrams, Berdo & Goodman, L.L.P.

(57) ABSTRACT

An apparatus and method for indexing the slag-metal interface level in a metallurgical container uses an insulating refractory brick having a plurality of embedded conductor wires. Distal ends of the conductor wires are exposed at know, fixed distances from the distal end of the stick and flush with the brick face. The proximal ends of the conductor wires protrude a predetermined distance from the proximal end of the brick. The brick is attached to the inner lining of the container at a known distance from the floor of the container. The proximal wire ends are joined by a suitable connector to a signal-transmission cable containing a matching number of individual conductors, which is connected to a multi-channel voltmeter. Output from the multi-channel voltmeter can be input to a multiple-channel PC-based signal interpretation instrument. During operation the voltage output of each sensor circuit is continuously monitored. A multiple-channel impedance-measuring device is also incorporated into each sensor circuit to continuously monitor individual circuit impedance without disturbing the internally generated DC voltage signal, ensuring that the value of the displayed voltage accurately reflects sensor output and not some unrelated property of the electromagnetic environment. If the circuit impedance falls outside predetermined limits, the system is disabled and cannot be reset, providing an indication of the need to take alternative action.

19 Claims, 4 Drawing Sheets

REFRACTORY MATERIAL SENSOR FOR DETERMINING LEVEL OF MOLTEN METAL AND SLAG AND METHOD OF USING

FIELD OF THE INVENTION

This invention relates to an apparatus and method for measuring the level of molten steel in a steel containment vessel. More particularly, the invention relates to the fabrication and use of a non-conductive refractory brick attached to the side wall of a steel containment vessel a predetermined distance from the floor of the vessel, the brick having a plurality of embedded conductors connected at one end to a multiple-channel voltmeter for determining the location of the interface between molten steel and slag, and slag and air, relative to the top or bottom of the vessel.

BACKGROUND OF THE INVENTION

In a steelmaking and casting operation, batches of partially refined molten steel are tapped from a basic-oxygen or electric-arc furnace into a refractory-lined ladle. Final refining to the specified chemical composition is performed in the ladle which is then drained into a bathtub-type vessel, also refractory lined, called a tundish, that simultaneously drains into water-cooled copper molds where the steel solidifies into a specific shape such as slab, bloom or billet.

The initial transfer from furnace to ladle is executed by tilting the furnace and draining the liquid contents through an opening in the furnace shell known as a taphole. After refining, and with the ladle upright, the transfer of liquid steel to the tundish is controlled by a slide-gate valve attached to a refractory nozzle in the ladle bottom. Likewise the draining rate from the tundish is controlled by one or more slide-gate/nozzle combinations in the tundish floor, or by a vertically movable refractory plug over the nozzle known as a stopper.

The cast steel is pulled continuously into a cooling bed by pinch rolls underneath the mold. While in motion, the hot slabs, blooms or billets issuing from the casting machine are cut to length prior to further rolling.

Typically, a string of ladles of refined steel is drained sequentially into the same tundish before changing tundishes by an operation known as a tundish "fly."

An inevitable consequence of the furnace-ladle-tundish-mold transfer operations is the presence of a slag layer over the molten steel. In the steelmaking furnace, a significant amount of "oxidized" slag is generated that is detrimental to final refining of the steel to the targeted composition. Thus, in the transfer of steel from furnace to ladle through the taphole, it is desirable to prevent significant carryover of furnace slag. In ladle refining, the objective is to form a "reducing" slag that is prepared by deliberate addition of appropriate fluxing agents. Although this reducing slag is not deleterious to the refined steel from the standpoint of chemical reactivity, carryover into the tundish in the form of entrained droplets, if not completely de-entrained before the steel solidifies, compromises the surface and internal quality of the cast product. Furthermore, some slag is eventually generated in the tundish itself by melting of; (1) "free-opener" sand, and; (2) insulating powder added to the tundish to form a protective blanket over the liquid surface. If a significant amount of liquid slag inadvertently reaches the mold, the rate of heat extraction by the mold is diminished, creating an opportunity for the liquid core in the solidified steel shell to break out, a highly unwelcome event that disrupts operations, causes equipment damage and carries the risk of a life-threatening explosion.

In the initial transfer of liquid steel from a furnace to a ladle, technology has been developed to limit the amount of furnace slag carried over into the ladle. For example, in an electric-arc furnace equipped with an eccentric-bottom-tapping (EBT) system, virtually slagfree tapping is achieved by the geometric configuration of the taphole relative to the furnace hearth and by melting surplus steel scrap that is retained in the furnace as a liquid reserve, known as a heel, after filling the ladle to the desired weight. However, in the event the scrap charge is "short," there is a risk of significant carryover of oxidized slag into the ladle. This slag must be removed by skimming, an operation affecting overall productivity, yield, and electrical energy consumption. Thus, in order to maximize the benefit of the EBT configuration, a slag-detecting system is required that shuts off the liquid flow automatically before the amount of slag in the ladle becomes significant. Effective slag-detecting devices installed near the taphole are available, but no art has been developed for measuring the amount of slag retained in the furnace. Knowledge of the amount of slag retained in the furnace has significant value, particularly in the production of low-phosphorus steel.

Effective slag-detecting devices have also been developed that limit the amount of ladle slag carried over into the tundish. However, such devices rarely achieve an operational availability of 100 percent. If, for example, the slag alarm fails in only one of ten ladles drained into a particular tundish, the amount of slag present before the tundish is removed from service is subject to a serious degree of uncertainty, undermining the effectiveness of tundish weight measurements (determined by load cells) to gauge the depth of the steel bath. To be certain that slag does not reach the mold when an unknown amount is present in the tundish, the tundish is shut off early, incurring a yield penalty in the form of a larger-than-necessary tundish "skull." In addition, the lining-wear profiles of individual tundishes vary over time, amplifying the lack of precision in the relationship between tundish weight and steel bath depth. Furthermore, as mentioned above, casting operations are susceptible to adverse events if the steel bath depth happens to stray outside safe limits.

Various systems have been developed for measuring the liquid level in remote storage vessels such as water tanks. Some examples are shown in U.S. Pat. No. 3,461,722 to Martens and U.S. Pat. No. 4,903,530 to Hull. One method is based on a change in the magnitude of an electrical current flowing in a circuit when an insulated electrode, placed at a known elevation inside the tank, makes or breaks contact with the liquid surface. The electrical circuit requires a power source, which typically supplies a constant DC voltage, allowing circuit resistance to be measured directly. Since the electrical circuit is open when the electrode is not in contact with the liquid, the change in resistance between an open and closed condition is massive, typically several orders of magnitude.

In baths of molten metal, particularly molten steel, measurement of liquid level is complicated by the presence of a supernatant slag layer of unknown thickness. U.S. Pat. No. 4,365,788 to Block; U.S. Pat. No. 3,395,908 to Woodcock; U.S. Pat. No. 3,505,062 to Woodcock; U.S. Pat. No. 4,413,810 to Tenberg; and U.S. Pat. No. 3,663,204 to Jungwirth teach that a change in the resistance of a sensing circuit can be utilized to detect the steel-slag interface level. However, the theoretical basis and application of such a resistance measuring device is suspect, for example, if the containment vessel for the liquid steel has an internal diameter at the slag-steel interface of 3 meters and contains an extraordinarily thick layer of molten slag of 0.5 meter, the resistance of such a layer, top to bottom, is approximately 0.00007 to 0.002 ohm, far below the threshold needed for reliable interpretation. As a practical matter, the minimum length of copper-conductor cable required to deliver the sensing circuit signal to a signal converter or control pulpit a safe distance away from the hot vessel, is approximately 20 to 30 meters. The resistance of a single strand of 16 gage copper wire, 20 meters long, is approximately 0.5 ohm at ambient temperature. Despite molten slag having a specific resistivity about 7000 times greater than liquid steel, which in turn has a specific resistivity about 70 times higher than ambient copper, such differences are overwhelmed by the relatively large volume of, and short conducting distances in, the liquid phases such that these methods are not easily and economically usable.

U.S. Pat. No. 4,365,788 to Block also teaches that combination electrodes embedded in the wall of a metallurgical vessel can be used to measure variables such as lining wear, liquid level, steel-slag interface level and temperature, based on changes in resistance of a circuit with an applied power source. However, Block does not teach how a change in the single parameter of resistance can distinguish between multiple phenomenological causes. Furthermore, internally generated DC voltages at junctions between dissimilar conductors at high temperature, such as caused by Seebeck and double-layer effects, make circuit resistance changes difficult, if not impossible, to interpret.

U.S. Pat. Nos. 4,037,761, 4,150,974, and 4,235,423, all to Kemlo, disclose interface level detection based on a change in voltage output from a single conducting probe. Three designs are disclosed, one for measurement of slag-layer thickness and interface level in a full ladle, and two for interface level detection during ladle draining. For the measurement in a full ladle, a moveable electrode is disclosed that is suspended above the ladle and that can be made to travel vertically through the slag layer by means of a winching device. The moveable electrode assembly comprises a conducting metal rod or tube connected by a non-conducting black-rubber, or ebonite, bushing to a second tube. A conductor wire from a suitable instrument passes through an opening in the upper tube through the bushing to the lower rod where it terminates.

However, such a device cannot provide a reliable indication of slag-layer thickness because of the extreme hostility of the environment above a ladle of molten steel. It is well known that a piece of metal immersed in molten slag would immediately become coated with frozen slag that would then take some time to melt off. Once the electrode is in contact with molten metal the only way of knowing whether the tip barely protrudes through the slag layer or is several inches below it, is to withdraw the probe. Since a solid conductor in contact with liquid metal would start to dissolve and/or melt, capture of the exact elevation of the slag-metal interface is problematical. In addition, as a practical matter, the slag surface could be solidified into a hard crust that requires a rugged "push-pull" mechanism and a second, sacrificial probe to penetrate.

For the interface level measurement during ladle emptying, one embodiment is a conducting probe embedded in a refractory sleeve of a stopper rod employed for draining the ladle. With the advent of effective slide-gate valves, the use of stopper rods to control steel flow from ladles has virtually disappeared. In an alternative embodiment a single electrode of steel, graphite or molybdenum is embedded in a lining brick located near the centerline of the ladle trunnions to detect when the steel-slag interface passes this elevation as the ladle is drained. However, regardless of the selection of electrode material, this design is susceptible to two performance-impairing phenomena. The first is caused by the electrode having a higher thermal conductivity than the refractory brick in which it is embedded, known as electrode "fogging," where a skin or "skull" of solidified metal forms over the electrode, effectively extending it downwards by an unknown distance. The second factor is electrode "blinding," that arises from the widespread practice of extending ladle lining life by a patching practice known as "gunning," in which a jet of refractory slurry is directed at high wear areas of the ladle lining. Here the objective of always maintaining contact between the electrode and molten steel is at loggerheads with the objective of maximum time interval between ladle relines.

Some additional examples of interface level detection are disclosed in U.S. Pat. No. 4,345,746 to Schleimer, U.S. Pat. No. 5,827,474 to Usher et al. U.S. Pat. No. 5,375,816 to Ryan; U.S. Pat. Nos. 5,549,280 and 5,650,117 to Kings et al disclose methods for detecting the presence of a non-metallic liquid phase in a flowing steel stream and interpreting the properties of the sensing-circuit signal.

Thus, there remains a need for an economical and practical device that determines the location of the molten metal-slag interface and slag-air interface in containment vessels that overcomes the limitations of the prior art and provides a reliable signal for halting a liquid transfer operation at the optimum moment in time. Furthermore, there is a need for a device that can determine the location of the molten metal-slag interface in a tundish so that inadvertent discharge of slag or overflow of steel can be prevented.

SUMMARY OF THE INVENTION

Accordingly, it is a primary object of the present invention to provide an apparatus and method for determining the location of the metal-slag interface in refractory-lined containment vessels employed in steelmaking and casting processes.

Another object of the present invention is to provide an apparatus and method for making a molten metal-slag interface measuring device having a plurality of probes embedded in a refractory brick attached to the refractory lining of a tundish.

Another object of the present invention is to provide an apparatus and method for measuring the voltage generated between an electrode and a molten metal bath in order to determine the location of the interface between the molten metal and the supernatant slag layer and for measuring the circuit impedance in order to determine the location of the interface between liquid metal or slag and air.

Another object of the present invention is to provide an apparatus and method for measuring the depth of molten metal and slag in a vessel using a plurality of electrodes embedded in a brick made from refractory material and placed at a predetermined distance from the container bottom.

In accordance with one aspect of the invention, a sensor for determining the level of molten metal and slag in a container having a refractory lining includes a brick having first and second electrically conductive wires embedded therein. The wires are placed at predetermined locations within the brick, with each of the wires having an exposed distal end and a proximal end that is preferably exposed. A measuring device, for example a voltmeter, is electrically connected to the proximal wire ends for measuring the voltage generated at the interface between the distal wire ends and the molten metal, or between the distal wire ends and the slag. Internally generated DC voltages between dissimilar conductors in contact with each other at high temperatures are caused by various effects, including Seebeck and double layer effects. The Seebeck effect refers to an electromotive force (emf) or voltage generated at the point of contact between different electronic conductors, the magnitude of which is temperature dependent. The Seebeck effect is most commonly utilized in thermocouples to measure temperature. The double-layer effect is an emf between the bulk of an ionically conducting phase such as slag, and a boundary layer of slag in contact with an electronic conductor such as metal or graphite.

In accordance with another aspect of the invention, the brick could be in the form of a special shape of refractory commonly known as "furniture".

In accordance with another aspect of the invention, the brick is fabricated from a material similar in composition to the container refractory lining. This material can be approximately 40 to 95 percent alumina, or approximately 80 to 100 percent magnesia.

In accordance with another aspect of the invention, the wires embedded in the brick are an oxidation resistant metal or oxidation resistant metal alloy.

In accordance with another aspect of the invention, a second conductive material covers the exposed distal ends of the embedded wires. The second conductive material can be zirconia, thoria, alumina-graphite, zirconia-graphite, magnesia-graphite, a closed-one-end zirconia tube or a closed-one-end thoria tube. The alumina-graphite, zirconia-graphite and magnesia-graphite conductive materials have compositions within the range of approximately 40 to 80 percent of alumina, zirconia or magnesia, respectively. Additionally, each of the alumina-graphite, zirconia-graphite and magnesia-graphite materials contain approximately 10 to 40 percent carbon, of which approximately 30 to 100 percent is in the form of graphite. Thus, the alumina-graphite, zirconia-graphite and magnesia-graphite conductive materials contain approximately 3 to 40 percent graphite.

In this manner, a brick having at least two embedded wires, or electrodes, at known intervals is attached to the wall of a container. The proximal ends of the electrodes are connected to a multi-channel voltmeter; each electrode forming an individual circuit insulated from other electrode circuits. When molten metal is poured into the container, a voltage is generated between the exposed distal end of the electrode and the molten metal that can be measured by a circuit through ground. The magnitude of the voltage is a function of the electrical properties of the liquid phase with which it is in contact. Thus, when the electrode is in electrical contact with molten metal, an electronic conductor, a first voltage is produced. When the electrode is in electrical contact with slag, an ionic conductor, a different voltage is produced. As the molten bath rises or falls, a change in voltage is observed as each electrode contacts a different phase. Since the physical location of each electrode is known, the level of each liquid phase can be readily tracked.

BRIEF DESCRIPTION OF THE DRAWINGS

The various aspects, advantages and novel features of the present invention will be more readily comprehended from the following detailed description when read in conjunction with the appended drawings, in which.

Throughout the drawing figures, like reference numerals will be understood to refer to like parts and components.

DETAILED DESCRIPTION OF THE PREFERRED EMBODIMENTS

Figure 1:
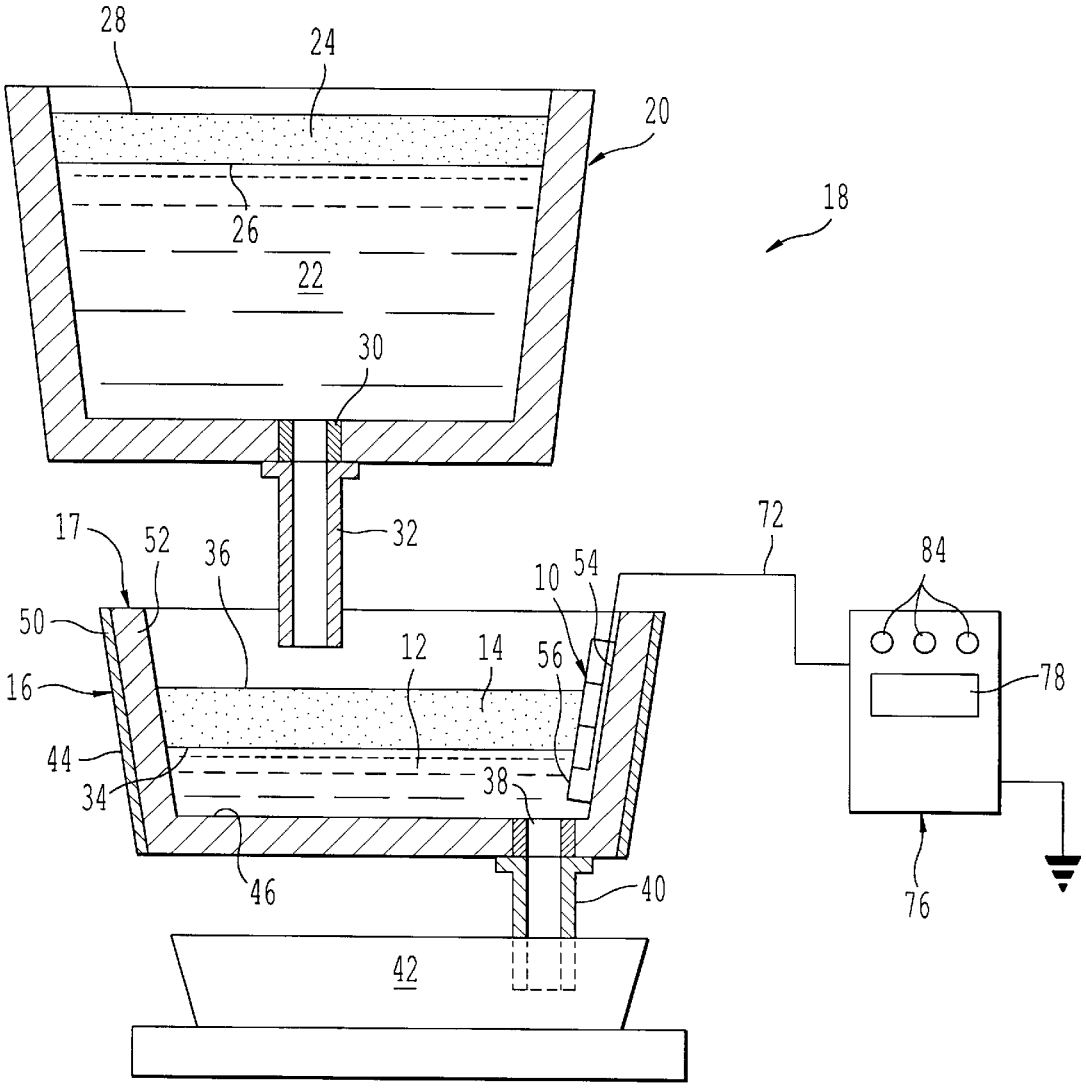
FIG. 1 is a schematic diagram of the steel casting process with a steel and slag depth measuring device in accordance with an embodiment of the invention, installed in the tundish of a continuous casting machine.
Figure 2:
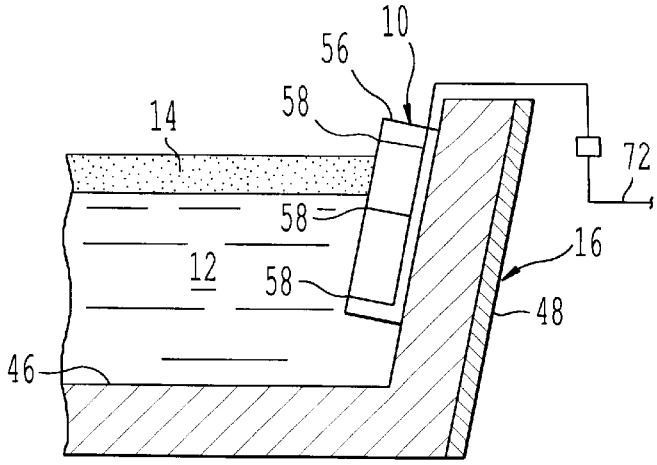
FIG. 2 is an enlarged view of the installed measuring device shown in FIG. 1.

A seen in FIG. 1, a level detector 10 for determining the depth of molten steel 12 and slag 14 in a tundish 16 in a continuous casting facility 18 for molten steel is illustrated. The continuous casting facility 18 will be described first in order to allow a clearer understanding of the nature of the present invention.

A ladle container 20 is disposed over a tundish 16. The ladle 20 contains a quantity of molten steel 22 covered by a layer of slag 24, that thermally insulates the molten steel 22 and isolates it from ambient oxygen. Between the upper surface of the molten steel 22 and the bottom surface of the slag 24 is a molten metal-slag interface 26. Similarly, an air-slag interface 28 is present at the top surface of the slag 24 that is likely to be solidified into a "crust." At the bottom of the ladle 20 is an outlet nozzle 30 connected to a slide-gate valve (not shown), that is connected to a tube or shroud 32, that allows molten steel 22 to flow into the tundish 16, without exposure to ambient oxygen.

When the molten steel 22 is released from the ladle 20 into the tundish 16, some slag 24 is also released before the ladle slide gate is closed. Over a period of time, a new layer of slag 14 is formed in the tundish 16 over the steel bath 12. Similarly, a molten steel-slag interface 34 and air-slag interface 36 are also formed in the tundish 16.

In the bottom of the tundish 16 is a nozzle 38, allowing the molten steel 12 to flow from the tundish 16 through a tube 40 into a water-cooled copper mold 42. The steel flow is controlled by a second slide gate attached to the underside of the tundish or, alternatively, by a refractory rod suspended in the liquid bath.

The tundish 16 is typically a trough or wedge-shaped container with sloping walls 44, having a capacity of about 25 tons to about 60 tons of molten steel. Objects, known as tundish furniture (not shown), may be placed in the tundish 16 for flow distribution control. The depth of the molten-metal bath during a casting operation may be between about two feet to about five feet above the floor 46 of the tundish 16. The tundish vessel 16 typically has an outer shell 48 of reinforced steel plate, a refractory safety lining 50 and a refractory "working" lining 52.

For each operational cycle of the tundish 16, that is, prior to being prepared for receiving molten steel 12, the residue from the previous operational cycle is removed and the working lining 52 coated with a contact lining which may be sprayed onto or otherwise applied to the working lining.

As shown in FIGS. 1–4, the level detector 10 in accordance with an embodiment of the present invention is a sensing device in the form of a refractory brick that can distinguish between contact with molten steel, molten slag or air, having embedded electrodes 54 placed at predetermined intervals. The level detector 10 is mounted on the working lining 52. The level detector 10 is a piece of electrically-insulating refractory brick 56, with embedded metallic conductor wires, or electrodes 54, exposed at fixed distances from the distal end of the brick. In the preferred embodiment, when the brick 56 is attached to working lining 52, the brick 56 projects into the interior of the tundish 16. The brick 56 is preferably positioned such that the top of the brick 56 is in close proximity to the top of the tundish 16, and the bottom of the brick 56 is proximate to the bottom of the tundish 16. For example, the top of the brick 56 can be almost flush with the lip 17 of the tundish 16 (FIG. 1).

The brick 56 is prepared by a conventional casting process in which a slurry of refractory particles is introduced into a mold of suitable dimensions in which the conductor wires 54 are held. The slurry is vibrated to achieve uniform density. The refractory material is an alumina-based material containing about 40–96% alumina, and preferably between 70–85% alumina. Alternatively, the refractory material can be 80–100% magnesia. In the preferred embodiment, the dimensions of the brick 56 are approximately two inches deep by three inches wide by twenty four to forty eight inches long. However, the brick can be fabricated into any shape and size that meets the needs of the liquid transfer operation. After the slurry has set, the "green" brick 56 is removed from the mold and excess wire snipped off. The green piece is hardened at a normal baking temperature of approximately 500 F to 600 F to remove most of the water of hydration. The remaining chemically-combined water is released during tundish preheat and during the initial tundish fill with molten steel. In the preferred embodiment, the rectangular brick 56 contains three embedded wires, or electrodes 54.

Figure 3:
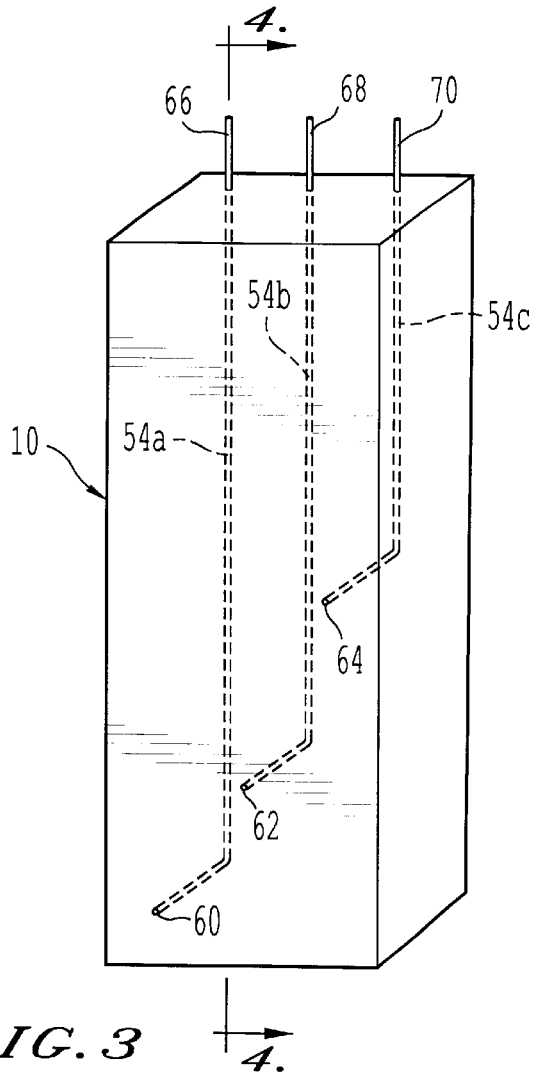
FIG. 3 is a schematic diagram of a measuring device.
Figure 4:
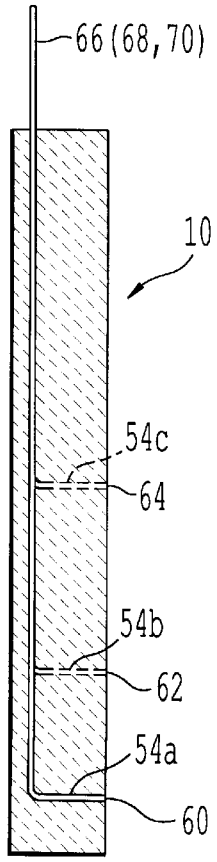
FIG. 4 is a cross-section of the measuring device of FIG. 3 taken along the line 4—4.

The brick 10 (FIG. 2) is mortared onto the working lining 52 a fixed distance from the floor of the tundish 46 so that the distal wire ends 58 are at known and fixed distances above the tundish floor 46 and from each other. A ground circuit measures the voltages generated by each electrode 54 in contact with a liquid phase in the tundish 16. The wires 54 are preferably formed from an oxidation-resistant nickel-based alloy or molybdenum. This three-wire configuration has the capability of controlling bath level during casting as well as closely controlling the steel-bath depth at the time of termination of draindown. Referring to FIGS. 3–4, the castable refractory brick 10 contains embedded sensor wires 54*a*, 54*b* and 54*c*. It will be understood that the distal wire ends 60, 62 and 64 will melt and co-mingle with molten steel in the tundish 16, but the cylindrical volume originally occupied by solid wire in the refractory brick 10 remains filled with liquid metal. In the event of exposure of the wire ends to the atmosphere from a drop in bath level, any liquid "wire" is retained in the brick 10 by gravity. Oxidation of wire ends 58 while temporarily exposed to the atmosphere does not impair operability. Upon re-contact with molten steel, any iron, nickel or chromium oxide that may have formed on the wire ends 58 is reduced by the aluminum dissolved in the steel, and metal-to-metal contact is rapidly reestablished. Co-mingling of molten steel with melted wire also does not impair operability, although the magnitude of the Seebeck effect between molten steel and alloy wire may slowly change because of a possible change in the length of metal of a composition between the bulk steel and the original wire. Also note that the protrusion of the brick from the inside of the tundish vessel reduces the risk of skull formation over the wire ends 58. Effective electrical contact between the wire ends 60, 62 and 64 and the molten bath is maintained by the ferrostatic pressure of the molten bath on the refractory wall.

The proximal wire ends 66, 68 and 70 are connected via a three-conductor signal-transmission cable 72 to an enclosure 76 containing a three-channel voltmeter, analog-to-digital converter cards, a flat panel industrial microcomputer or a microprocessor such as a programmable logic controller (PLC) and impedance-measuring cards. The panel monitor 78 displays "live" traces of voltage and impedance for each of the three sensor circuits.

The impedance cards continuously monitor individual circuit impedances without disturbing the internally generated DC voltage signals, ensuring that the value of the displayed voltages accurately reflect sensor outputs and not some unrelated property of , the electromagnetic environment. If a circuit impedance falls outside predetermined limits, a disabled signal is displayed that cannot be reset, providing a timely warning to take alternative action.

The instrumentation "package" depends only on changes in the internally generated circuit voltages and is independent of their polarity. The algebraic sum of all Seebeck and "double-layer" effects in each circuit is believed to determine the magnitude of the measured DC voltage.

Figure 5:
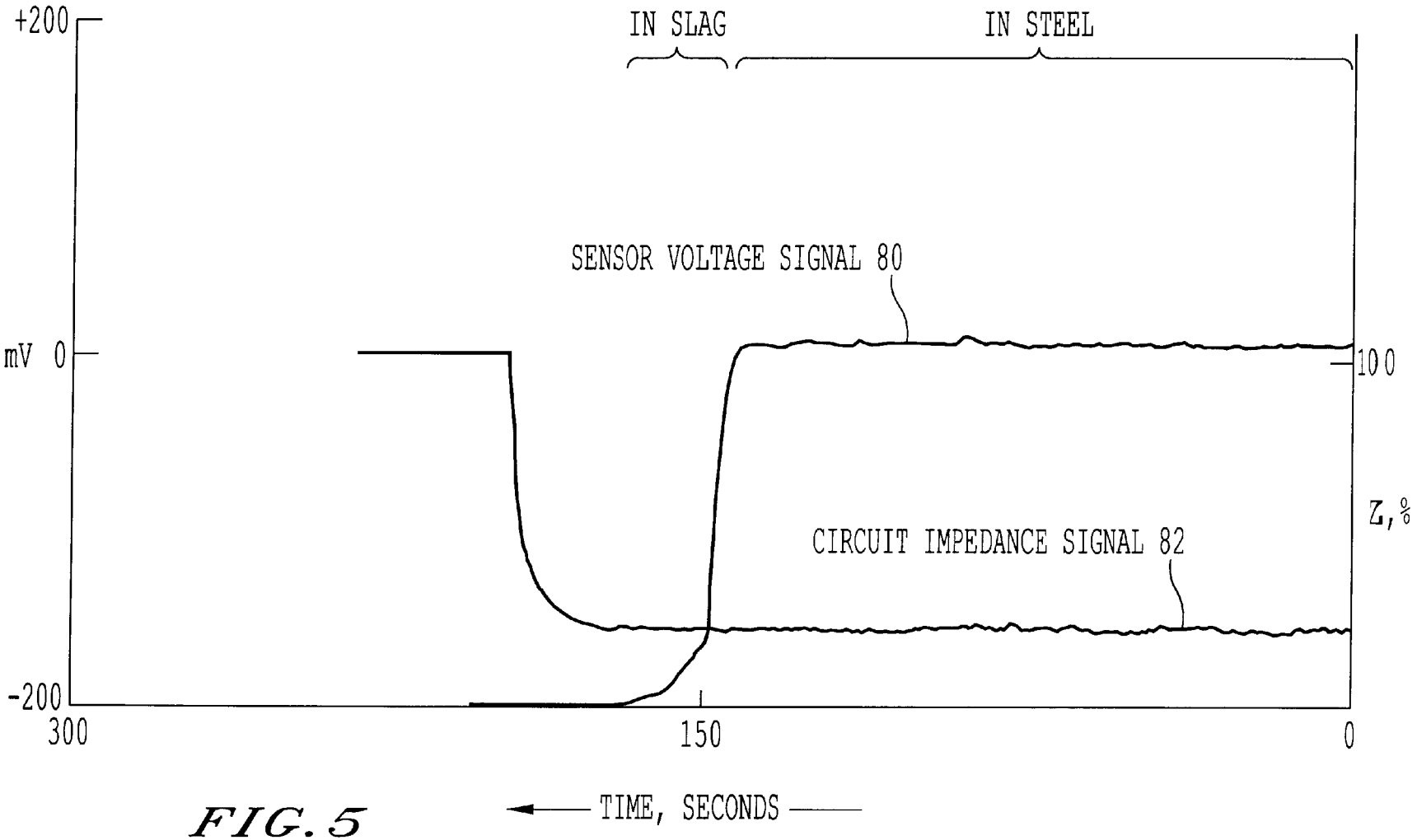
FIG. 5 is a voltage and impedance trace of an electrode in the measuring device as steel and slag are drained from a container.

FIG. 5 shows a voltage and impedance trace from a single electrode 54. The voltage trace 80 shows that when the electrode 54 is in contact with molten steel 12, the measured voltage is approximately 20 millivolts and the circuit impedance 82 is approximately 20% of scale, or about 2.5 ohms, i.e. essentially shorted. As the tundish 16 drains and the molten steel-slag interface 34 passes the electrode 54, the voltage signal 80 suddenly deflects to negative 150 millivolts without a measurable change in circuit impedance, clearly demarcating the transition between the molten steel 12 and slag 14. As the steel-slag interface continues to drop, the circuit impedance rises to 100 percent of scale—an open circuit condition indicative of an electrode pulling clear of slag and in contact with air.

With electrodes 54 positioned at predetermined distances, and the brick 56 installed at a predetermined location on the tundish wall 44, the depth of the molten-steel bath 12 can be readily tracked and the liquid transfer operation stopped at the optimum moment in time.

Colored lamps 84 (FIG. 1) mounted on enclosure 76 can display the operational status of each individual sensor circuit, according to any desired convention. For example, white can mean unarmed; green, armed; red, level alarm; amber, disabled. The computer 76 can be programmed to set off an alarm when one of the electrodes 54 contacts a phase other than the predetermined default phase. In the preferred embodiment, during casting the default contact phase for the lowest sensor 60 is liquid steel, the default contact phase for the top sensor 64 is air, while the default contact phase for the middle sensor 62 is steel. If sensor 64 comes in contact with molten steel or slag during casting, a visual or audible alarm is set off, indicating a high bath level. Likewise when sensor 62 comes in contact with air or slag, a low level alarm is activated. During draindown, sensor 60 is armed and immediately sets off an alarm when the steel-bath level falls below it, preparing the tundish 16 for imminent shut off. With appropriate interfacing between the enclosure 76 and the caster control computer, the draindown operation can be stopped automatically.

It will become apparent to one skilled in the art that more than three electrodes 54 can be placed in the brick 56.

Additionally, the size of the brick 56 can be adjusted to fit the size of the tundish 16 and that brick 56 could be attached to an article of tundish furniture such as a baffle for flow-distribution control or could be an integral part of the article of tundish furniture. Likewise, the brick 56 can be placed in the ladle 20 to measure the level of molten steel 22 and slag 24. Brick 56 can also be used to measure the height of any suitable molten material compatible with the material used for the electrodes 54.

With appropriate modifications, brick 56 with embedded electrodes 54 can be used to measure phase interface levels in foundry ladles, EBT electric arc furnaces, basic oxygen converters (BOF), argon-oxygen refining vessels (AOD), vacuum-oxygen refining vessels (VOD) and electric furnaces equipped with tapping valves.

Additionally, the device 10 can be used in pressure casting, for example, of steel or aluminum wheels. With an effective level indicator 10 in a ladle holding vessel, a good decision can be made by the user on when to terminate casting, eliminating the risk of a partial cast or leaving excess liquid metal in the ladle.

Figure 6:
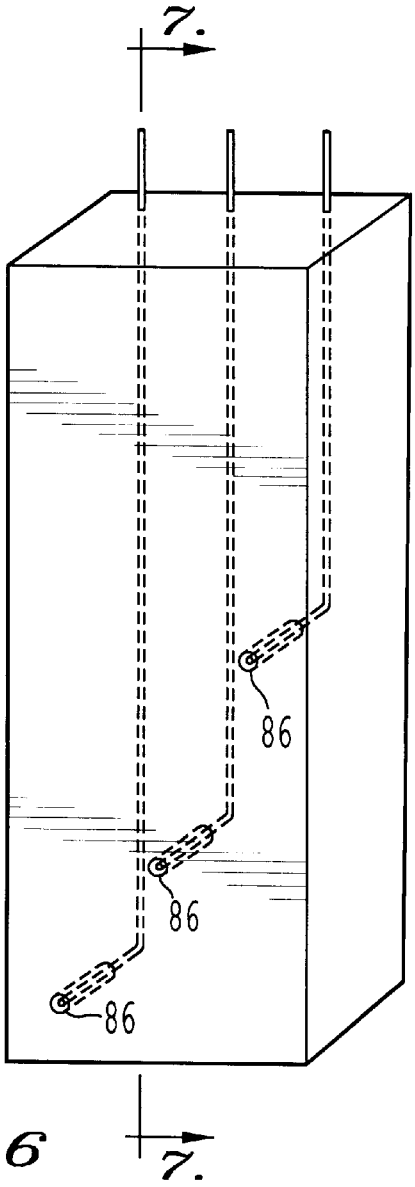
FIG. 6 is a schematic diagram of a second embodiment of a measuring device in accordance with the invention.
Figure 7:
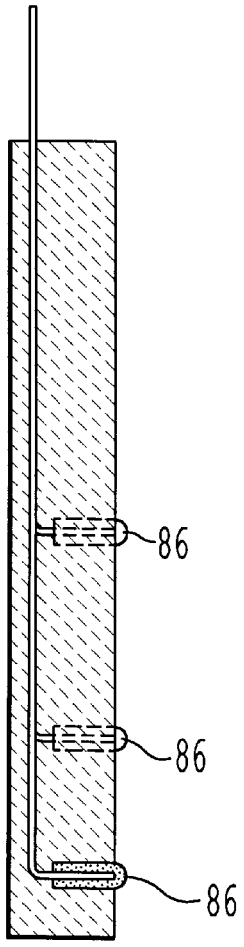
FIG. 7 is a cross-section of the second embodiment of FIG. 6 taken along the line 7—7.

In another embodiment, shown in FIGS. 6 and 7, the distal wire ends 60, 62 and 64 are in electrical contact with a second electrically conducting material 86 such as zirconia or thoria that can be closed-one-end tubes. The second conductors 86 are exposed to the molten steel bath 12 at the same predetermined distances as the distal wire ends 60, 62 and 64.

In yet another embodiment the distal wire ends 60, 62 and 64 are in electrical contact with a second electrically conducting material such as alumina-graphite, magnesia-graphite or zirconia-graphite. The second conductors are exposed to the molten steel bath 12 at the same predetermined distances as the distal wire ends 60, 62 and 64.

In a further embodiment, part of the brick 56 encasing the wires 54 is permeable and can be connected to a source of unreactive gas. For example, the gas can be one of argon, nitrogen and carbon dioxide. A flow of unreactive gas may help to maintain a clean surface on brick 56 and extend the number of phase changes detectable by wires 54.

Although the present invention has been described with reference to preferred embodiments thereof, it will be understood that the invention is not limited to the details thereof. Various modifications and substitutions have been suggested in the foregoing description, and others will occur to those of ordinary skill in the art. All such substitutions are intended to be embraced within the scope of the invention as defined in the appended claims.

What is claimed is:

1. A sensor for determining the level of molten metal and slag in a container having a refractory lining comprising:

a brick having at least first and second electrically conductive wires embedded at predetermined locations, each of said wires having an exposed distal end and a proximal end; and a measuring device electrically connected to said proximal wire ends for measuring a voltage generated at an interface between said distal wire ends and one of a group of materials including molten metal, slag and air.

2. The sensor of claim 1, wherein said container is a tundish.

3. The sensor of claim 1, wherein said refractory lining is fabricated from a non-conductive refractory material.

4. The sensor of claim 1, wherein said brick is fabricated from a nonconductive refractory material.

5. The sensor of claim 4, wherein said refractory material is approximately 40 to 96 percent alumina.

6. The sensor of claim 4, wherein said refractory material is approximately 70 to 85 percent alumina.

7. The sensor of claim 4, wherein said refractory material is approximately 80 to 100 percent magnesia.

8. The sensor of claim 1, wherein said wires are one of an iron-based alloy, a nickel-based alloy, an oxidation-resistant alloy containing chromium, titanium and molybdenum.

9. The sensor of claim 1, wherein each of said distal wire ends is covered by a second electrically conductive material, said second electrically conductive material being exposed to one of said group of materials.

10. The sensor of claim 9, wherein said second electrically conductive material is one of zirconia, thoria, closed-one-end zirconia tube, closed-one-end thoria tube, alumina-graphite, magnesia-graphite and zirconia-graphite.

11. The sensor of claim 1, wherein said measuring device is a voltmeter.

12. The sensor of claim 11, wherein output of said voltmeter is displayed on one of a strip chart recorder and a video monitor.

13. The sensor of claim 1, wherein said brick is attached to said refractory lining.

14. A method for determining the location of an interface between molten metal and slag in a container having a refractory lining, comprising the steps of:

attaching a sensor having at least two electrodes at a predetermined location on the refractory lining of said container, each of said electrodes having an exposed proximal end and an exposed distal end;

electrically connecting each of said exposed proximal ends to a voltage measuring device:

introducing a melt containing said molten metal into said container;

detecting and recording a voltage generated at an interface between each of said exposed distal ends and said melt;

releasing said melt from said container;

determining the location of said interface between said molten metal and slag when said voltage potential between said exposed distal ends and said melt changes.

15. The method of claim 14, wherein said melt is concurrently introduced into and released from said container.

16. The method of claim 14, further comprising the step of outputting said voltage to a computer, said computer determining the location of said interface.

17. The sensor of claim 11, further comprising a computer adapted to receive an output from said voltmeter to monitor said voltage generated at said interface between said distal wire ends and one of said group of materials.

18. The sensor of claim 17, wherein said computer is further adapted to monitor said output continuously.

19. The sensor of claim 17, further comprising an alarm device connected to said computer and adapted to alert a user when said output of said voltmeter exceeds a predetermined value.

* * * * *